US011441839B2

(12) United States Patent
Asse et al.

(10) Patent No.: US 11,441,839 B2
(45) Date of Patent: Sep. 13, 2022

(54) INTEGRATED METHOD AND UNIT FOR AIR SEPARATION BY CRYOGENIC DISTILLATION AND GAS COOLING

(71) Applicant: L'Air Liquide, Societe Anonyme pour l'Etude et l'Exploitation des Procedes Georges Claude, Paris (FR)

(72) Inventors: Alexis Asse, Montreuil (FR); Tobias Oelmann, Bad Vilbel (DE)

(73) Assignee: L'Air Liquide, Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 561 days.

(21) Appl. No.: 16/466,796

(22) PCT Filed: Aug. 31, 2017

(86) PCT No.: PCT/FR2017/052315
§ 371 (c)(1),
(2) Date: Jun. 5, 2019

(87) PCT Pub. No.: WO2018/104598
PCT Pub. Date: Jun. 14, 2018

(65) Prior Publication Data

US 2020/0080772 A1 Mar. 12, 2020

(30) Foreign Application Priority Data

Dec. 5, 2016 (FR) ..... 1661936

(51) Int. Cl.
*F25J 3/04* (2006.01)

(52) U.S. Cl.
CPC ..... *F25J 3/04527* (2013.01); *F25J 3/04563* (2013.01); *F25J 2205/34* (2013.01); *F25J 2260/44* (2013.01)

(58) Field of Classification Search
CPC .. F17C 2265/03; F25J 1/0025; F25J 2210/90; F25J 2245/90; F25J 3/04; F25J 3/04521; F25J 3/04527; F25J 3/04533; F25J 3/04539; F25J 3/04545; F25J 2270/12; F25J 2270/42; F25J 2270/906; F25J 2270/908; F25J 2260/42; F25J 2260/44; F25J 2260/50; C01B 2203/061; C01B 2203/0883
See application file for complete search history.

(56) References Cited

U.S. PATENT DOCUMENTS

| | | | | |
|---|---|---|---|---|
| 6,393,867 | B1 | 5/2002 | Guillard | |
| 2005/0234278 | A1 | 10/2005 | van Egmond et al. | |
| 2014/0208798 | A1* | 7/2014 | Cognard | B01D 53/62 62/617 |
| 2018/0170503 | A1* | 6/2018 | Shin | F25J 1/0202 |

FOREIGN PATENT DOCUMENTS

| | | |
|---|---|---|
| EP | 0 748 763 | 12/1996 |

OTHER PUBLICATIONS

International Search Report and Written Report for PCT/FR2017/052315, dated Nov. 29, 2017.

* cited by examiner

*Primary Examiner* — Jianying C Atkisson
*Assistant Examiner* — Erik Mendoza-Wilkenfel
(74) *Attorney, Agent, or Firm* — Justin K. Murray

(57) ABSTRACT

According to an embodiment of the invention, nitrogen gas of an air separation unit is used to cool the gas formed in a reservoir of liquid from an MEOH unit that is supplied with oxygen by said air separation unit.

13 Claims, 1 Drawing Sheet

INTEGRATED METHOD AND UNIT FOR AIR SEPARATION BY CRYOGENIC DISTILLATION AND GAS COOLING

The present invention relates to an integrated method and an integrated unit for separating air by cryogenic distillation and for cooling a gas. The cooling makes it possible to cool, or even at least partially condense, a gas originating from a store which contains a liquid; the liquid is produced by a unit supplied with a gas originating from the air separation unit.

It is often necessary to store liquids at low temperature, i.e. at temperatures below ambient temperature. The stores are insulated to prevent the ambient heat from evaporating the liquid but nonetheless defects in the insulation give rise to ingresses of heat and gas is formed at the top of the store. This gas must be either discharged to the atmosphere or recondensed and sent back to the store.

Figure 1:
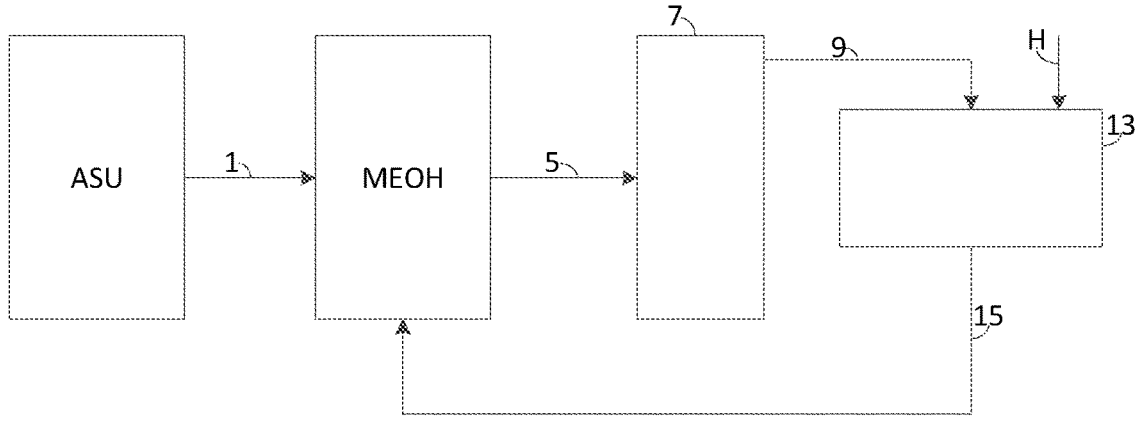
FIG. 1 (Prior Art)

Another possibility, illustrated in FIG. 1, is to dissolve the gas in demineralized water H and to send it to a purification unit. In the figure, a cryogenic distillation air separation unit ASU produces oxygen 1 which is sent to a methanol production unit MEOH. The methanol produced in liquid form is sent to an insulated store 7. The methanol in gaseous form 9 formed at the top of the store by the ingresses of heat through the insulation is sent to be mixed with demineralized water H in a unit 13. The methanol formed 15 is sent back to the purification section in the methanol production unit MEOH.

In order to condense the gas, another possibility is to use water cooled by an electric refrigerator to a temperature of 10° C. which exchanges frigories with the gas in a heat exchanger via indirect exchange.

In many cases, a cryogenic distillation air separation unit produces oxygen at the request of a customer, but there is no customer for the nitrogen, or even all the nitrogen, which is inevitably co-produced.

According to the invention, the nitrogen produced in excess is used at the outlet of the air separation unit for cooling water in a direct-contact tower fed at the bottom with cold nitrogen gas and at the top by the water to be cooled.

The cooled water is then used to cool, or even to condense a gas originating from a store of a liquid at a subambient temperature, make it possible to reduce the electric power consumption.

A process according to the preamble of claim 1 is known from EP-A-0 748 763.

According to one subject of the invention, a process as claimed in claim 1 is provided.

According to other optional aspects of the invention:

the unit is a methanol production unit;

the air sent for distillation is cooled by means other than a heat exchanger fed by the cooled water originating from the first tower;

a first flow of nitrogen-enriched gas is sent to the first tower and a second flow of nitrogen-enriched gas is sent to a purification unit which is used to purify the air intended for the distillation;

the ratio between the first flow of nitrogen and the oxygen-enriched flow sent to the production unit is less than 0.7:1, or even less than 0.1:1;

the cooled water leaves the first tower at a temperature below 50° C. or below 15° C., or even below 10° C.;

the condensation step is carried out by cooling in a refrigeration means using electrical energy.

According to another aspect of the invention, an integrated unit as claimed in claim 8 is provided.

According to other optional aspects:

the unit comprises no means for cooling the air intended for the distillation receiving cooled water from the first tower;

the unit comprises a store of an alkene produced from the liquid product which is methanol, the gas originating from the store of the alkene being cooled by means of cooled water originating from the first tower, condensed and sent back to the store of alkene.

The store may for example be a store of liquid methanol or of liquid propylene.

The liquid contained in the store preferably has a boiling point at the pressure inside the store of below 50° C. or below 15° C., or even below 10° C., or even below 0° C.

For a store of methanol at 1.1 bar abs, the saturation temperature is 11° C. and for a store of propylene at 16 bar, the saturation temperature is 40° C.

Figure 2:
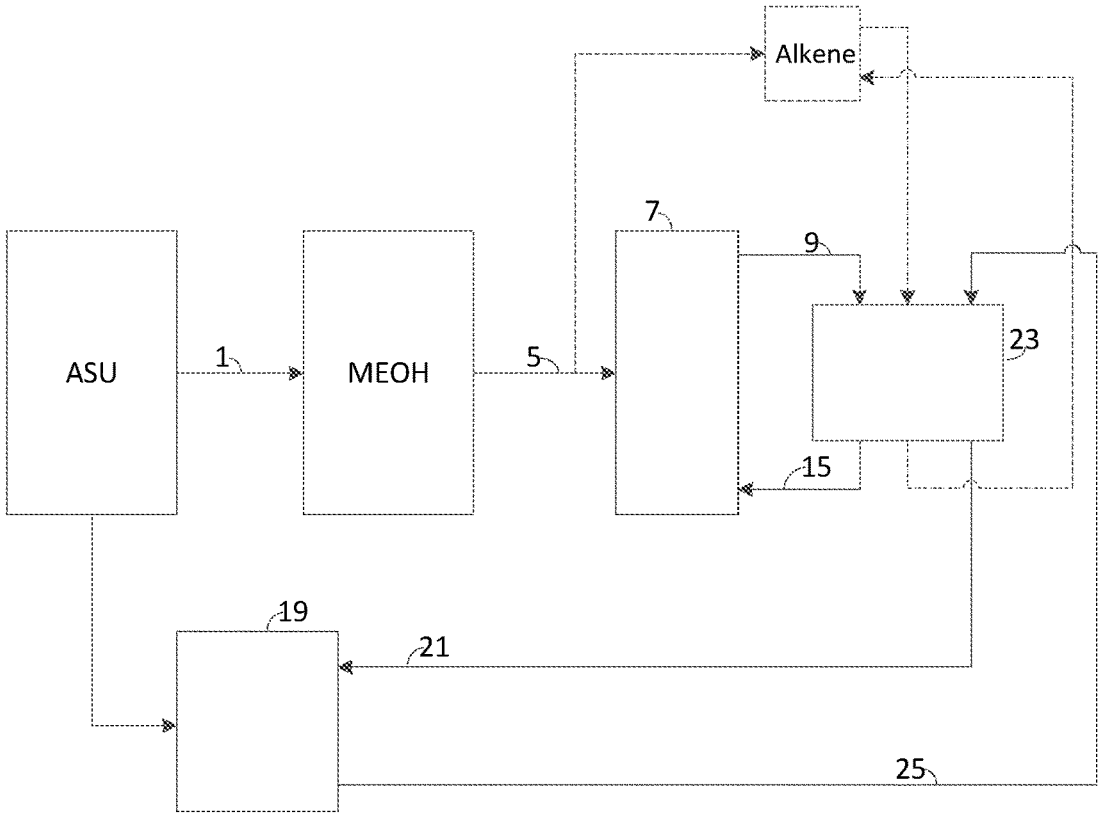

The process will be described in greater detail with reference to FIG. 2. A cryogenic distillation air separation unit ASU produces oxygen 1 which is sent to a methanol production unit MEOH. The methanol produced in liquid form is sent to an insulated store 7 at 1.1 bar abs. The methanol in gaseous form 9 formed at the top of the store by the ingresses of heat through the insulation is sent to a heat exchanger 23 which is a brazed aluminium plate exchanger. In this exchanger, either it is completely condensed or it is cooled or it is partially condensed in order to be completely condensed by another means. The condensing temperature may be in the vicinity of 11° C. The condensed gas is sent back to the store 7.

The air separation unit ASU also produces nitrogen gas 17 which is heated by heat exchange with the air to be separated. This nitrogen gas 17 is sent to the bottom of a cooling tower 19 fed at the top by water 21 to be cooled. The nitrogen gas contacts the water to be cooled and the reheated nitrogen leaves at the top of the tower 19 whilst the cooled water 25 leaves at the bottom of the tower 19. The cooled water 25 is sent to the heat exchanger 23 in order to cool or even to condense, at least partially, the gas 9.

The feed air sent to the air separation unit ASU in order to be separated therein is preferably not cooled by heat exchange with the cooled water in the tower 19. Preferably, no element of the air separation unit is cooled by heat exchange with the cooled water in the tower 19. Thus, the cooling tower 19 provides cooled water not for the cooling of the air separation unit but for, preferably solely for, cooling the evaporated gas 9 originating from the store 7 or from other stores that are not used to store a fluid originating from the air separation unit.

According to another variant, cooled water from the bottom of the tower 19 is used to cool air intended for the distillation in the ASU unit. In this case, the cooling may be carried out by means of a second tower fed at the top with cooled water and at the bottom with the air to be cooled. Only a portion of the cooled water will be available for cooling the gas 9 originating from the store 7.

It can be envisaged to collect nitrogen from several air separation units, at least one of which supplies oxygen-enriched gas to the production unit MEOH which produces the methanol. The nitrogen collected may be sent to a common cooling tower for all the distillation units and then be sent to one or more stores for cooling the gases produced by reheating.

The methanol is often converted into other alkenes which are also stored at subambient temperature and are liable to evaporate. The gases originating from at least one store of alkene produced from the methanol from the production unit MEOH may also be cooled by the nitrogen from the air separation unit, using water from the cooling tower 19 or from a cooling tower common to several air separation units. The alkene may for example be propylene, stored at 16 bar abs with a saturation temperature of 40° C.

The invention claimed is:

1. An integrated method for separating air by cryogenic distillation and for cooling a gas originating from an insulated storage of a liquid produced by a production unit supplied with a gas originating from the air separation unit (ASU), wherein the method comprises the steps of:

i. separating air in the air separation unit, which comprises at least one cryogenic distillation unit that is configured to produce an oxygen-enriched gas and a nitrogen-enriched gas;

ii. sending the oxygen-enriched gas from the ASU to the production unit, thereby producing a liquid in the production unit; and iii. sending nitrogen-enriched gas from the ASU to a bottom of a first tower for exchange of mass and heat by direct contact, and sending water to a top of the first tower, the temperature of the water entering the tower being greater than that at which the nitrogen-enriched gas enters the first tower, wherein the production unit for producing a liquid comprises the insulated storage that is configured to store the liquid, the liquid having a boiling point at the pressure inside the insulated storage of below 50° C., wherein the method further comprises the steps of:

drawing off a gas formed in the insulated storage;

drawing off the cooled water from the first tower and then using the cooled water to cool or at least partially condense at least one portion of the gas formed in the insulated storage in order to form a first fluid of the cooled or at least partially condensed at least one portion of the gas;

optionally, condensing the first fluid if the first fluid is not completely condensed; and sending the first fluid back to the insulated storage in liquid form.

2. The process as claimed in claim 1, wherein the production unit is a methanol production unit.

3. The process as claimed in claim 1, wherein the air sent for distillation is cooled by means other than a heat exchanger fed by the cooled water originating from the first tower.

4. The process as claimed in claim 1, wherein a first flow of nitrogen-enriched gas is sent to the first tower and a second flow of nitrogen-enriched gas is sent to a purification unit, which is used to purify the air intended for the distillation.

5. The process as claimed in claim 4, wherein the ratio between the first flow of nitrogen and the oxygen-enriched flow sent to the production unit is less than 0.7:1.

6. The process as claimed in claim 4, wherein the ratio between the first flow of nitrogen 7) and the oxygen-enriched flow sent to the production unit is less than 0.1:1.

7. The process as claimed in claim 1, wherein the cooled water leaves the first tower at a temperature below 50° C.

8. The process as claimed in claim 1, wherein the cooled water leaves the first tower at a temperature below 10° C.

9. The process as claimed in claim 1, wherein the step of condensing the first fluid is carried out by cooling in a refrigeration means using electrical energy.

10. The process as claimed in claim 1, wherein the liquid has a boiling point at the pressure inside the insulated storage below 0° C.

11. An integrated unit for separating air by cryogenic distillation and for cooling, the integrated unit comprising:

a cryogenic distillation air separation unit (ASU);

a line for drawing off a nitrogen-enriched gas from the air separation unit;

a line for drawing off an oxygen-enriched gas from the air separation unit, said line for drawing off an oxygen-enriched gas being connected to a production unit and configured to send the oxygen-enriched gas to the production unit;

a first mass and heat exchange tower, a bottom of the first tower being connected to the line for drawing off the nitrogen-enriched gas, and a top of the first tower being connected to water supply means; and a line for drawing off cooled water from the first tower, wherein the production unit comprises:

at least one insulated storage that is configured to store a liquid product having a boiling point at the pressure of the at least one insulated storage;

a reheating gas line in fluid communication with a head space of the insulated storage that is configured to draw off a reheated gas resulting from a reheating of the liquid product within the at least one insulated storage, wherein the line for drawing off the cooled water from the first tower is configured to send cooled water to a heat exchanger connected to the reheating gas line, the heat exchanger being fluidly connected to the at least one insulated storage in order to send the reheating gas, after cooling in the heater exchanger, back to the at least one insulated storage.

12. The integrated unit as claimed in claim 11, wherein the at least one insulated storage is an alkene storage that is configured to store an alkene produced from the liquid product which is methanol, wherein the reheated gas originating from the alkene storage is cooled by the cooled water originating from the first tower, the reheated gas originating from the alkene storage being condensed by the cooled water and sent back to the alkene storage.

13. The integrated unit as claimed in claim 11, wherein the at least one insulated storage is configured to store liquid methanol or liquid propylene.

* * * * *